US010913139B1

(12) United States Patent
Jenkins et al.

(10) Patent No.: US 10,913,139 B1
(45) Date of Patent: Feb. 9, 2021

(54) PIPE SUPPORT STAND

(71) Applicants: La Nard Jenkins, Moreno Valley, CA (US); Felicia Jenkins, Moreno Valley, CA (US)

(72) Inventors: La Nard Jenkins, Moreno Valley, CA (US); Felicia Jenkins, Moreno Valley, CA (US)

( * ) Notice: Subject to any disclaimer, the term of this patent is extended or adjusted under 35 U.S.C. 154(b) by 218 days.

(21) Appl. No.: 16/200,832

(22) Filed: Nov. 27, 2018

(51) Int. Cl.
*B25B 1/20* (2006.01)
*B25H 1/00* (2006.01)
*B25H 1/10* (2006.01)

(52) U.S. Cl.
CPC ..... *B25B 1/205* (2013.01); *B25H 1/0042* (2013.01); *B25H 1/10* (2013.01)

(58) Field of Classification Search
CPC ..... B25B 1/20; B25B 1/205; B25B 1/2484; B25B 5/147; B25H 1/0021; B25H 1/0035; B25H 1/0042; B25H 1/005; B25H 1/02; B25H 1/04; B25H 1/06; B25H 1/08; B25H 1/10; B23Q 1/74; B23Q 3/105
See application file for complete search history.

(56) References Cited

U.S. PATENT DOCUMENTS 960,916 A * 6/1910 Heiser ..... B25B 1/20 269/129
1,126,544 A * 1/1915 Martin ..... B21D 5/04 72/322
1,458,738 A * 6/1923 Teeken ..... B25H 1/00 269/296
1,658,826 A * 2/1928 Yerk ..... B23Q 1/74 451/411
1,686,023 A * 10/1928 McCloskey ..... B25B 1/2484 269/129
1,785,884 A * 12/1930 Vosper ..... B25B 1/20 269/130
1,798,340 A * 3/1931 Thewes ..... B25H 1/00 72/460
2,310,255 A * 2/1943 O'Connell ..... F16L 3/00 269/98
D317,687 S 6/1991 Fabius
5,193,598 A 3/1993 Estrem
5,526,856 A 6/1996 Pedri
5,592,981 A 1/1997 Derecktor
6,155,318 A 12/2000 Underwood
7,140,409 B2 11/2006 Leberfinger

FOREIGN PATENT DOCUMENTS

EP 2409815 7/2014

* cited by examiner

*Primary Examiner* — Tyrone V Hall, Jr.

(57) ABSTRACT

The pipe support stand is an attachment for a tripod chain vise. The pipe support stand attaches to two of the three legs of the tripod chain vise and provides a work support leg that runs under the work piece at an oblique angle to the ground and to the work piece. The front end of the work support leg may rise towards the work piece and the work piece may slide onto one of two brackets on the front end of the work support leg such that the device provides support to the end of the work piece that is about to be cut off. Alternatively, the work support leg may slide towards the rear such that the rear end of the work support leg contacts the ground and provides additionally stability for the tripod chain vise.

16 Claims, 4 Drawing Sheets

PIPE SUPPORT STAND

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of tools, more specifically, a pipe support stand.

SUMMARY OF INVENTION

The pipe support stand is an attachment for a tripod chain vise. The pipe support stand attaches to two of the three legs of the tripod chain vise and provides a work support leg that runs under the work piece at an oblique angle to the ground and to the work piece. The front end of the work support leg may rise towards the work piece and the work piece may slide onto one of two sleeves on the front end of the work support leg such that the pipe support stand provides support to the end of the work piece that is about to be cut off. Alternatively, the work support leg may slide towards the rear such that the rear end of the work support leg contacts the ground and provides additionally stability for the tripod chain vise.

An object of the invention is to couple the pipe support stand to a tripod chain vise.

Another object of the invention is to provide support for a work piece by sliding the work piece through a sleeve at the front of the pipe support stand.

A further object of the invention is to provide more than one sleeve so that work pieces of different diameters may be supported.

Yet another object of the invention is to provide a work support leg that may slide towards the rear of the tripod chain vise, contact the ground, and provide additional stability for the tripod chain vise.

These together with additional objects, features and advantages of the pipe support stand will be readily apparent to those of ordinary skill in the art upon reading the following detailed description of the presently preferred, but nonetheless illustrative, embodiments when taken in conjunction with the accompanying drawings.

In this respect, before explaining the current embodiments of the pipe support stand in detail, it is to be understood that the pipe support stand is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pipe support stand.

It is therefore important that the claims be regarded as including such equivalent construction insofar as they do not depart from the spirit and scope of the pipe support stand. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
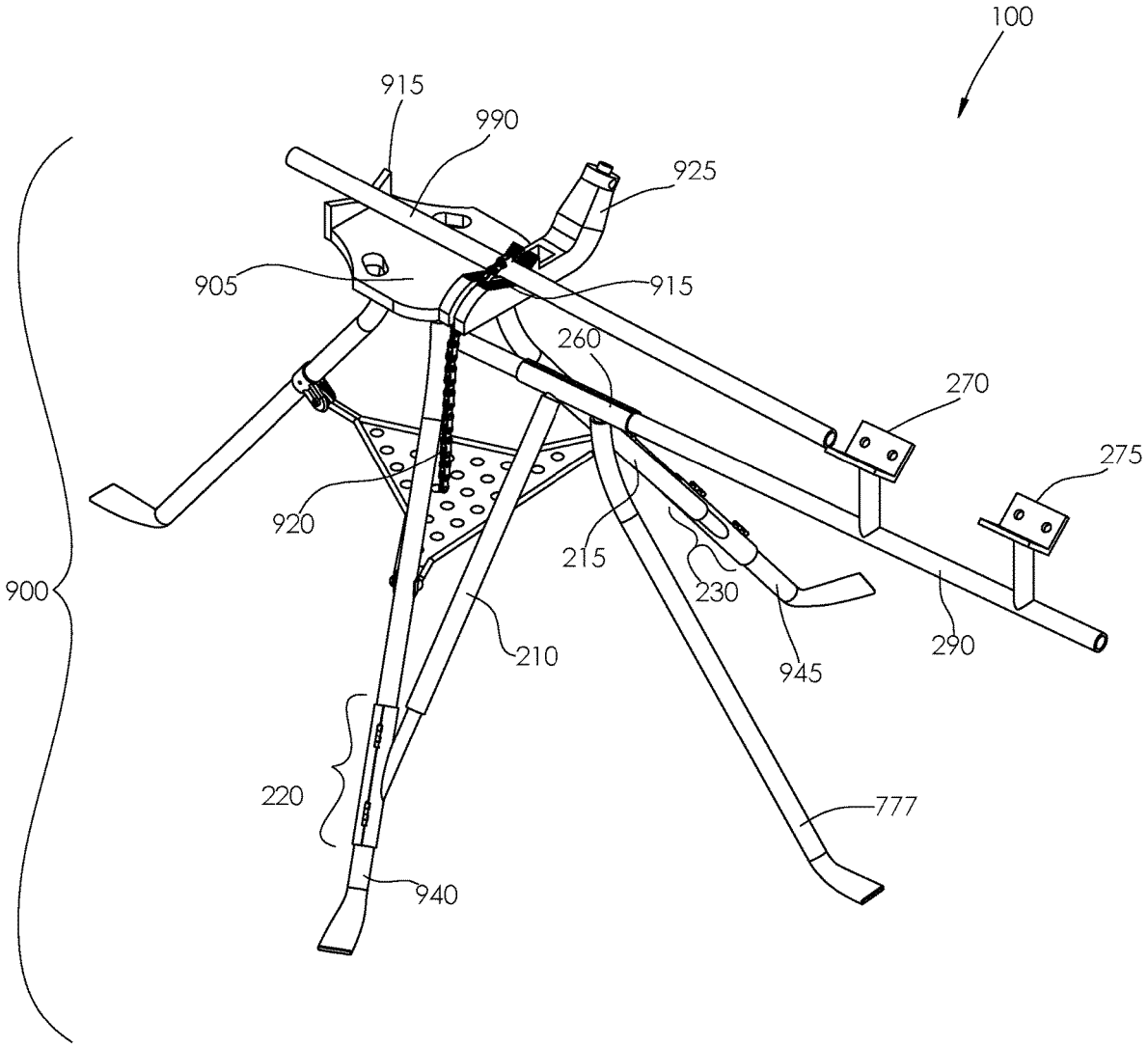
FIG. 1 is a perspective view of an embodiment of the disclosure.
Figure 2:
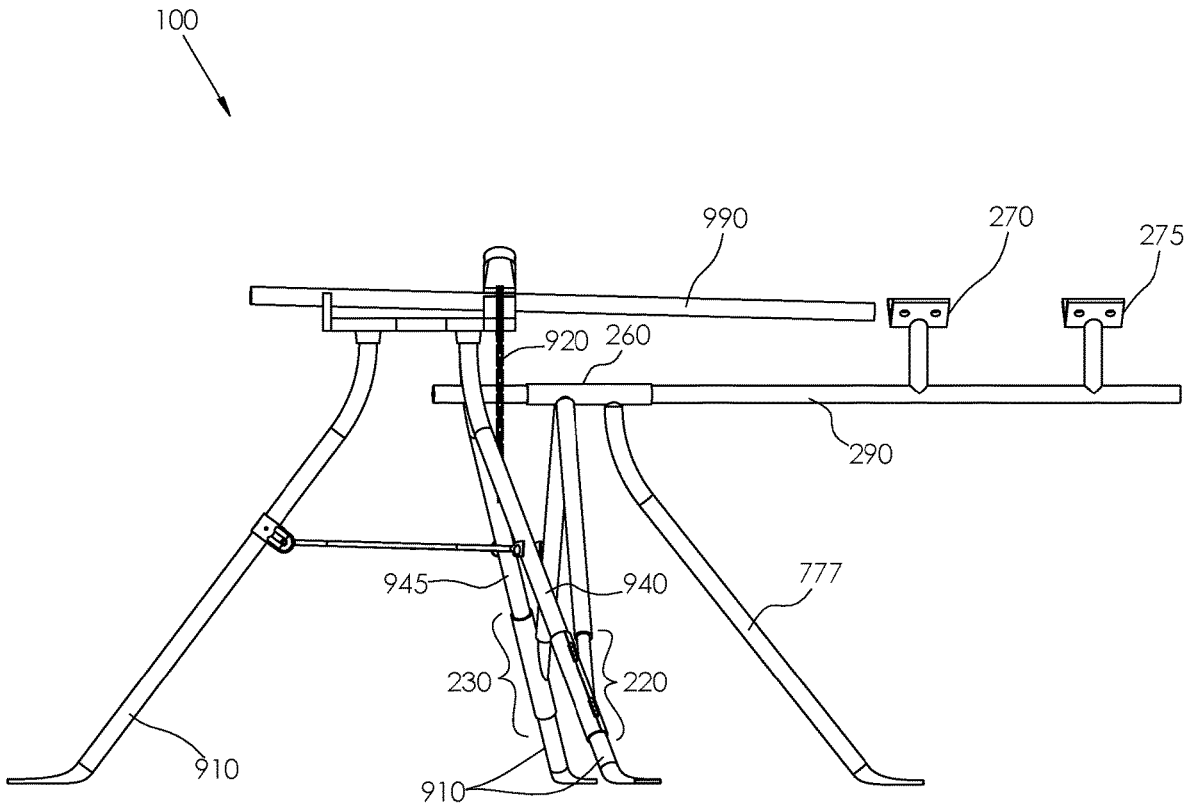
FIG. 2 is a side view of an embodiment of the disclosure.
Figure 3:
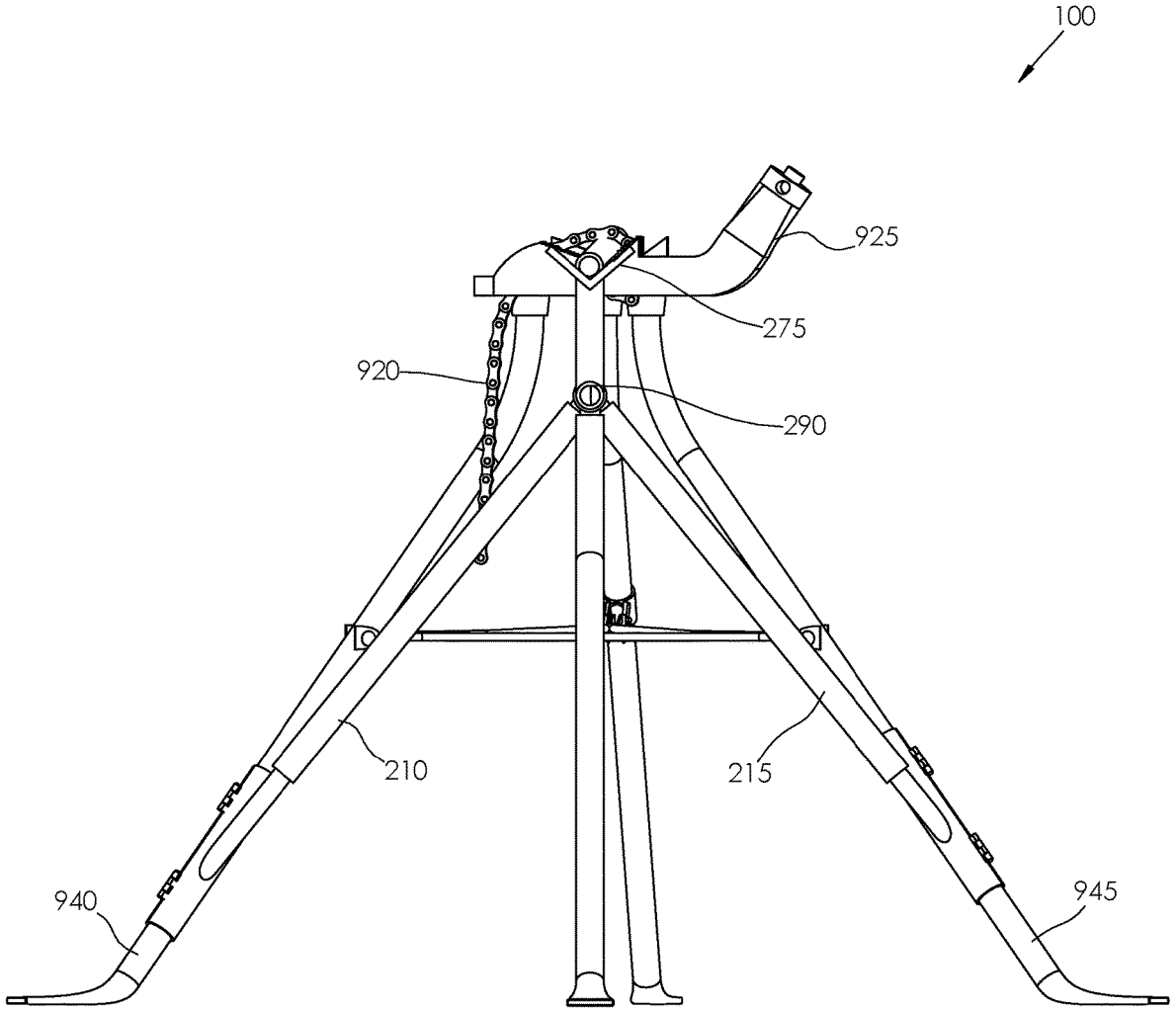
FIG. 3 is a front view of an embodiment of the disclosure.
Figure 4:
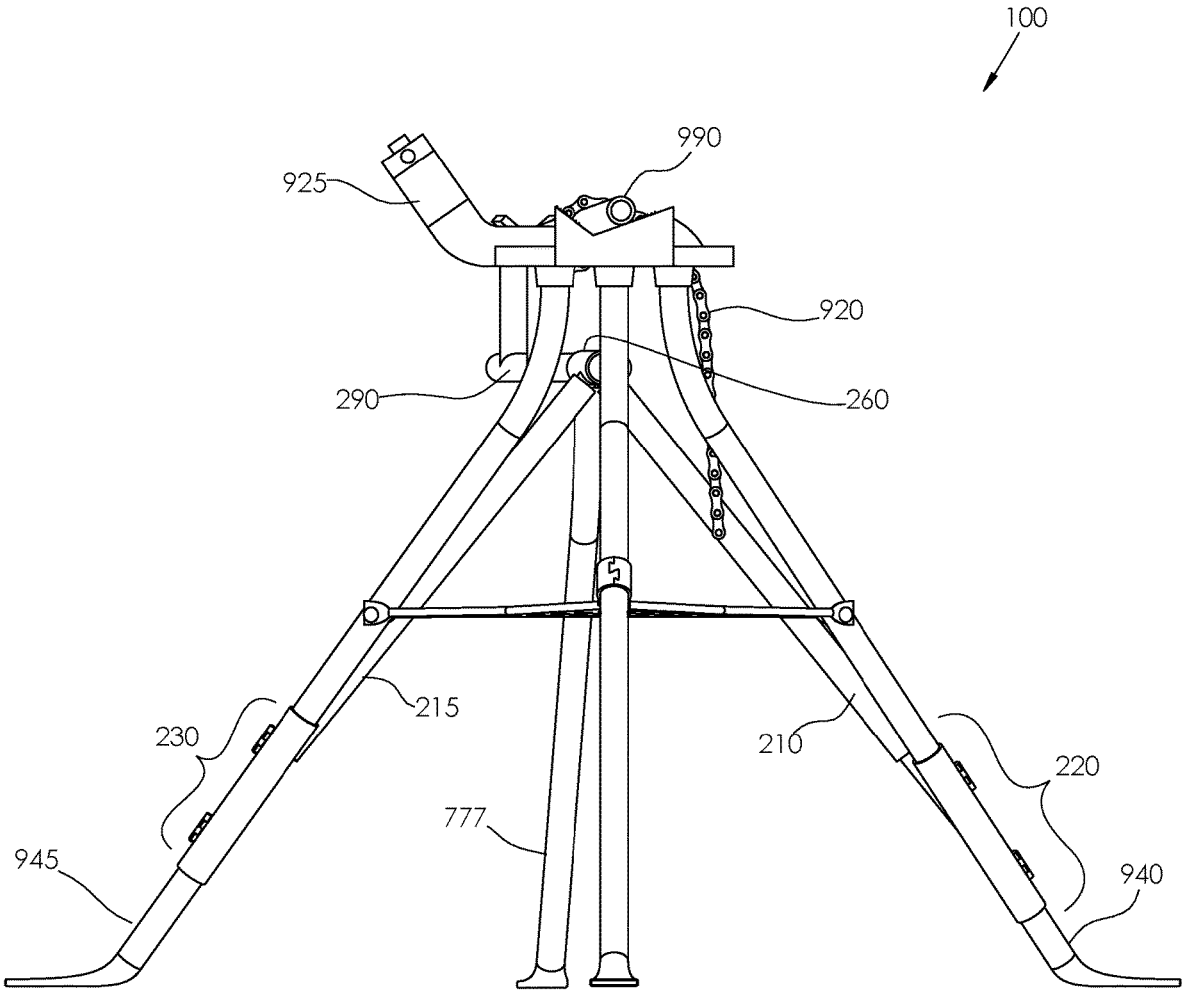
FIG. 4 is a rear view of an embodiment of the disclosure.

Detailed reference will now be made to a first potential embodiment of the disclosure, which is illustrated in FIGS. 1 through 4.

The pipe support stand 100 (hereinafter invention) comprises a first attachment coupler 220, a second attachment coupler 230, a first attachment leg 210, a second attachment leg 215, a three-way coupler 260, a work support leg 290, a first pipe bracket 270, and a second pipe bracket 275. The invention 100 attaches to a tripod chain vise 900 to stabilize the tripod chain vise 900 and/or to support a work piece 990 being cut on the tripod chain vise 900.

The tripod chain vise 900 comprises a work surface 905 support by three legs 910. The work surface 905 generally provides two V-shaped notches 915 on opposing sides of the work surface 905 to center the work piece 990 and a chain 920 to hold the work piece 990 in place while the work piece 990 is cut. The chain 920 may be held down by draping the chain 920 over the work piece 990, latching one side, and then cranking a top screw 925 to pull the over side of the chain 920 tight. Non-limiting examples of the work piece 990 may include a pipe, conduit, strut, or bar. The chain 920 may be coupled to the work surface 905 on one end and free on the other end. The free end of the chain 920 may be routed over the top of the work piece 990 and latched to the work surface 905 prevent the work piece 990 from moving.

The bottom ends of the first attachment leg 210 and the second attachment leg 215 may attach to a first tripod leg 940 and a second tripod leg 945 on the tripod chain vise 900 via the first attachment coupler 220 and the second attachment coupler 230, respectively. The top ends of the first attachment leg 210 and the second attachment leg 215 may coupled to the three-way coupler 260. The three-way coupler 260 may couple to the work support leg 290 such that the work support leg 290 is secured to the first attachment leg 210, the second attachment leg 215, and a forward leg 777.

The first attachment coupler 220 may removably couple to the first tripod leg 940 of the tripod chain vise 900. As a non-limiting example, the first attachment coupler 220 may comprise a first hinged clamp 222 that separates on one side along a longitudinal line and hinges on the opposing side along a longitudinal line such that the first hinged clamp 222 may be wrapped around a pipe, hinged closed, and fixed in place. The first hinged clamp 222 may be loosened, may slide along the first tripod leg 940 to reposition the first attachment coupler 220, and may be tightened again to hold the first attachment coupler 220 in place.

The first attachment coupler 220 may comprise a first end cap 226 that is hingedly coupled to the first hinged clamp 222 via a first hinge 224. The open end of the first end cap 226 may couple to the first attachment leg 210. The first hinge 224 may be loosened and pivoted to reposition of the first attachment leg 210 and then tightened to hold the first attachment leg 210 in place. As non-limiting examples, the first attachment coupler 220 may be fixed in place and the first hinge 224 may be tightened using set screws or thumbscrews.

The second attachment coupler 230 may removably couple to the second tripod leg 945 of the tripod chain vise 900. As a non-limiting example, the second attachment coupler 230 may comprise a second hinged clamp 232 that separates on one side along a longitudinal line and hinges on the opposing side along a longitudinal line such that the second hinged clamp 232 may be wrapped around a pipe, hinged closed, and fixed in place. The second hinged clamp 232 may be loosened, may slide along the second tripod leg 945 to reposition the second attachment coupler 230, and may be tightened again to hold the second attachment coupler 230 in place.

The second attachment coupler 230 may comprise a second end cap 236 that is hingedly coupled to the second hinged clamp 232 via a second hinge 234. The open end of the second end cap 236 may couple to the second attachment leg 215. The second hinge 234 may be loosened and pivoted to reposition of the second attachment leg 215 and then tightened to hold the second attachment leg 215 in place. As non-limiting examples, the second attachment coupler 230 may be fixed in place and the second hinge 234 may be tightened using set screws or thumbscrews.

The first attachment leg 210 and the second attachment leg 215 may be struts that position the work support leg 290 under the work piece 990. The lower end of the first attachment leg 210 may be coupled to the first attachment coupler 220. The upper end of the first attachment leg 210 may be coupled to the three-way coupler 260.

The lower end of the second attachment leg 215 may be coupled to the second attachment coupler 230. The upper end of the second attachment leg 215 may be coupled to the three-way coupler 260.

The three-way coupler 260 may be a fitting that couples the first attachment leg 210, the second attachment leg 215, the forward leg 777, and the work support leg 290 to each other. The three-way coupler 260 may hold the work support leg 290 to the first attachment leg 210, the second attachment leg 215, and the forward leg 777. The three-way coupler 260 may hold the work support leg 290 at an oblique angle relative to the work piece 990. The three-way coupler 260 may be loosened, the work support leg 290 may be moved forward or rearward by sliding the work support leg 290 through the three-way coupler 260, and the three-way coupler 260 may be tightened to retain the work support leg 290 the new position. As non-limiting examples, the three-way coupler 260 may be loosened and tightened using set screws or thumbscrews.

The work support leg 290 may be held below the work piece 990 by the first attachment coupler 220, the second attachment coupler 230, the first attachment leg 210, the second attachment leg 215 and the three-way coupler 260. The work support leg 290 may be oriented at an angle such that the front end of the work support leg 290 is closer to the work piece 990 than the rear end of the work support leg 290.

The front end of the work support leg 290 may comprise the first pipe bracket 270 and/or the second pipe bracket 275. The work support leg 290 may be moved to a forward position such that the front end of the work support leg 290 is beneath and adjacent to the work piece 990. The work piece 990 may slide onto the first pipe bracket 270 or onto the second pipe bracket 275 such that the work support leg 290 supports at least a portion of the weight of the work piece 990. The support provided to the work piece 990 by the work support leg 290 and the first pipe bracket 270 or the second pipe bracket 275 may prevent the work piece 990 from sagging as the work piece 990 is cut from a longer piece of stock.

The first pipe bracket 270 and the second pipe bracket 275 may be fittings that support the work piece 990.

In some embodiments, the work support legs 290 may slide towards the rear through the three-way coupler 260 such that the rear end of the work support leg 290 contacts the ground. The work support leg 290 may be used to make the tripod chain vise 900 more stable by providing a fourth point of contact with the ground. In some embodiments, the rear end of the work support leg 290 may be flattened into a foot for use when contacting the ground.

In use, the tripod chain vise 900 is set up at a work site and the invention 100 is attached to it by coupling the first attachment coupler 220 to the first tripod leg 940 and the second attachment coupler 230 to the second tripod leg 945. The positions and angles of the first attachment coupler 220 and the second attachment coupler 230 are adjusted to place the work support leg 290 under the work piece 990 at a desired angle. If the invention 100 will be used to provide additional stability to the tripod chain vise 900, the work support leg 290 is slid to the rear until it touches the ground and is them tightened in place. If the invention 100 will be used to support the work piece 990 as the work piece 990 is cut, the work support leg 290 is slid to the front and the first pipe bracket 270 or the second pipe bracket 275 are aligned with the work piece 990. The work piece 990 is slid into the first pipe bracket 270 or the second pipe bracket 275 and then cut. The cut portion of the work piece 990 is removed from the invention 100 and the remaining portion of the work piece 990 may be slid forward into the first pipe bracket 270 or the second pipe bracket 275 to make the next cut.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, a "chain" is a series of interlinked rings that form a cord like structure. Like a cord, a chain has tensile strength but is too flexible to provide compressive strength and is not suitable for use in pushing objects. The rings to form a chain are often formed from a metal.

As used herein, the words "couple", "couples", "coupled" or "coupling", refer to connecting, either directly or indirectly, and does not necessarily imply a mechanical connection.

As used herein, the word "desired" refers to a specific value or action within a range of supported values or action. A "desired" value or action indicates that a range of values or actions is enabled by the invention and that a user of the invention may select a specific value or action within the supported range of values or action based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, a "diameter" of an object is a straight line segment that passes through the center (or center axis) of an object. The line segment of the diameter is terminated at the perimeter or boundary of the object through which the line segment of the diameter runs.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "hinge" is a device that permits the turning, rotating, or pivoting of a first object relative to a second object.

As used herein, the word "longitudinal" or "longitudinally" refers to a lengthwise or longest direction.

As used herein, "oblique angle" refers to any angle that is not a right angle or a multiple of a right angle.

As used in this disclosure, a "sleeve" is a tube like covering that is placed over a rod, shaft or other cylindrical object.

As used herein, "thumb screw" and "wing nut" refer to fasteners that are designed to be tightened and loosened by hand without the use of tools. As non-limiting examples, thumb screws and wing nuts may be screws, bolts, or nuts that include any or all of the following features: oversized dimensions, knurled sides, one or more upward extensions, or one or more lateral extensions.

As used in this disclosure, a "tripod" is a three legged stand that is used to support a visual recording device.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A pipe support stand comprising:

a first attachment coupler, a second attachment coupler, a first attachment leg, a second attachment leg, a three-way coupler, a work support leg, a first pipe bracket, and a second pipe bracket;

wherein the pipe support stand attaches to a tripod chain vise to stabilize the tripod chain vise and/or to support a work piece being cut on the tripod chain vise;

wherein the bottom ends of the first attachment leg and the second attachment leg attach to a first tripod leg and a second tripod leg on the tripod chain vise via the first attachment coupler and the second attachment coupler, respectively;

wherein the top ends of the first attachment leg and the second attachment leg couple to the three-way coupler;

wherein the three-way coupler couples to the work support leg such that the work support leg is secured to the first attachment leg, the second attachment leg, and a forward leg;

wherein the first attachment coupler removably couples to the first tripod leg of the tripod chain vise;

wherein the first attachment coupler comprises a first hinged clamp that separates on one side along a longitudinal line and hinges on the opposing side along a longitudinal line such that the first hinged clamp is wrapped around a pipe, hinged closed, and fixed in place;

wherein the first hinged clamp is loosened, slides along the first tripod leg to reposition the first attachment coupler, and is tightened again to hold the first attachment coupler in place.

2. The pipe support stand according to claim 1 wherein the first attachment coupler comprises a first end cap that is hingedly coupled to the first hinged clamp via a first hinge;

wherein the open end of the first end cap couples to the first attachment leg;

wherein the first hinge is loosened and pivoted to reposition of the first attachment leg and then tightened to hold the first attachment leg in place.

3. The pipe support stand according to claim 2 wherein the first attachment coupler is fixed in place and the first hinge is tightened using set screws or thumbscrews.

4. The pipe support stand according to claim 2 wherein the second attachment coupler removably couples to the second tripod leg of the tripod chain vise.

5. The pipe support stand according to claim 4 wherein the second attachment coupler comprises a second hinged clamp that separates on one side along a longitudinal line and hinges on the opposing side along a longitudinal line such that the second hinged clamp is wrapped around a pipe, hinged closed, and fixed in place;

wherein the second hinged clamp is loosened, slides along the second tripod leg to reposition the second attachment coupler, and is tightened again to hold the second attachment coupler in place.

6. The pipe support stand according to claim 5
wherein the second attachment coupler comprises a second end cap that is hingedly coupled to the second hinged clamp via a second hinge;
wherein the open end of the second end cap couples to the second attachment leg;
wherein the second hinge is loosened and pivoted to reposition of the second attachment leg and then tightened to hold the second attachment leg in place.

7. The pipe support stand according to claim 6
wherein the second attachment coupler is fixed in place and the second hinge is tightened using set screws or thumbscrews.

8. The pipe support stand according to claim 6
wherein the first attachment leg and the second attachment leg are struts that position the work support leg under the work piece.

9. The pipe support stand according to claim 8
wherein the lower end of the first attachment leg is coupled to the first attachment coupler;
wherein the upper end of the first attachment leg is coupled to the three-way coupler.

10. The pipe support stand according to claim 9
wherein the lower end of the second attachment leg is coupled to the second attachment coupler;
wherein the upper end of the second attachment leg is coupled to the three-way coupler.

11. The pipe support stand according to claim 10
wherein the three-way coupler is a fitting that couples the first attachment leg, the second attachment leg, the forward leg, and the work support leg to each other;
wherein the three-way coupler holds the work support leg secured to the first attachment leg, the second attachment leg, and the forward leg;
wherein the three-way coupler holds the work support leg at an oblique angle relative to the work piece;
wherein the three-way coupler is loosened, the work support leg is moved forward or rearward by sliding the work support leg through the three-way coupler, and the three-way coupler is tightened to retain the work support leg the new position.

12. The pipe support stand according to claim 11
wherein the work support leg is held below the work piece by the first attachment coupler, the second attachment coupler, the first attachment leg, the second attachment leg and the three-way coupler;
wherein the work support leg is oriented at an angle such that the front end of the work support leg is closer to the work piece than the rear end of the work support leg.

13. The pipe support stand according to claim 12
wherein the front end of the work support leg comprises the first pipe bracket and/or the second pipe bracket;
wherein the work support leg is moved to a forward position such that the front end of the work support leg is beneath and adjacent to the work piece;
wherein the work piece slides through the first pipe bracket or through the second pipe bracket such that the work support leg supports at least a portion of the weight of the work piece;
wherein the support provided to the work piece by the work support leg and the first pipe bracket or the second pipe bracket prevents the work piece from sagging as the work piece is cut from a longer piece of stock.

14. The pipe support stand according to claim 13
wherein the first pipe bracket and the second pipe bracket are fittings that support the work piece.

15. The pipe support stand according to claim 14
wherein the work support legs slide towards the rear through the three-way coupler such that the rear end of the work support leg contacts the ground;
wherein the work support leg is used to make the tripod chain vise more stable by providing a fourth point of contact with the ground.

16. The pipe support stand according to claim 15 wherein the rear end of the work support leg is flattened into a foot for use when contacting the ground.

* * * * *